US006079929A

United States Patent [19]

Muma et al.

[11] Patent Number: 6,079,929

[45] Date of Patent: Jun. 27, 2000

[54] REFUSE BAG OPENER

[75] Inventors: Joseph Harold Muma; Michael James Muma, both of St. Thomas, Canada

[73] Assignee: Muma Manufacturing Inc., Ontario, Canada

[21] Appl. No.: 09/085,834

[22] Filed: May 28, 1998

[51] Int. Cl.[7] ..... B65G 65/04

[52] U.S. Cl. ..... 414/412; 414/411

[58] Field of Search ..... 414/412, 411; 198/623, 622, 454, 455, 444, 524; 209/DIG. 930; 241/DIG. 38

[56] References Cited

U.S. PATENT DOCUMENTS

| | | | |
|---|---|---|---|
| 624,023 | 5/1899 | Heine | 414/412 |
| 2,920,355 | 1/1960 | Clark | 198/622 |
| 4,034,877 | 7/1977 | Bennison | 414/412 |
| 4,274,787 | 6/1981 | Mueller et al. | 414/412 |
| 4,504,183 | 3/1985 | Bennison et al. | 414/412 |
| 4,543,029 | 9/1985 | Grun et al. | 414/412 |
| 5,352,082 | 10/1994 | Bennison | 414/412 |
| 5,368,431 | 11/1994 | Willey et al. | 414/412 |
| 5,382,129 | 1/1995 | Shimizu et al. | 414/412 |
| 5,415,515 | 5/1995 | Bielagus et al. | 414/412 |
| 5,433,577 | 7/1995 | Roycraft | 414/412 |
| 5,484,238 | 1/1996 | Bielagus | 414/412 |
| 5,484,247 | 1/1996 | Clark et al. | 414/412 |
| 5,551,825 | 9/1996 | Montgomery | 414/412 |
| 5,567,106 | 10/1996 | Gassner | 414/412 |
| 5,613,824 | 3/1997 | Kato | 414/412 |
| 5,639,202 | 6/1997 | Roycraft | 414/412 |

FOREIGN PATENT DOCUMENTS

| | | |
|---|---|---|
| 2010489 | 1/1995 | Canada . |
| 2167772 | 8/1996 | Canada . |
| 2167997 | 8/1996 | Canada . |

*Primary Examiner*—Douglas Hess
*Attorney, Agent, or Firm*—Trevor C. Klotz

[57] ABSTRACT

A refuse bag opener that includes a material metering cylinder and a knife cylinder mounted therein and driven by a suitable power mechanism to rotate in opposite directions to feed bagged refuse therebetween. The metering cylinder and the knife cylinder are disposed in vertical spaced relation with the knife cylinder being the lowermost of the two. The hopper receives the bagged material and by way of a sloping lower wall directs the bagged material towards the knife cylinder. The lower sloped wall has a belt conveyor for direct feeding of the bagged material to the lower cylinder which by virtue of its rotation cuts the bag. The bagged refuse passes between the metering cylinder and the knife cylinder at a relatively even rate. A conveyor feeds the material from a supply source to the hopper and an outfeed conveyor delivers the emptied bags and contents of the bags to a suitable sorting location. Feed to the cutting cylinder is preferably no more than one bag deep and the feed is controlled by signals received from a sensing mechanism to control the hopper feed conveyor and/or an infeed conveyor within the hopper. The metering cylinder has a plurality of flexible members radiating outwardly from a shaft and are spaced circumferentially therearound. The outwardly radiating members are flexible. The hopper has an inlet end thereto offset horizontally in an upstream direction from the metering cylinder and knife cylinder.

11 Claims, 3 Drawing Sheets

REFUSE BAG OPENER

FIELD OF INVENTION

This invention relates to apparatus for opening bags containing refuse and such apparatus incorporating means to control the feed of bagged refuse to the bag opener and/or feed of the bagged refuse to a pair of vertically spaced apart counter rotating cylinders.

BACKGROUND OF INVENTION

Residential and commercial establishments bag their refuse and this bagged refuse is normally collected by packer trucks at regular intervals. Recycling programs have brought into use blue boxes, carts, etc. and historically municipalities have provided the blue boxes and carts. The pick-up in many municipalities of recyclable waste is a separate pick-up service.

The use of bags for collecting recyclables has many advantages one being it removes the cost from the municipality because bags are generally purchased by the user. Also bags have other benefits as pick-up is cheaper, less time consuming and simpler. Paper waste is also protected by the bags. From a collection point of view drivers can simply throw the bagged waste into the truck and move on to the next location where bags are located. Containers (blue boxes) and carts on the other hand have to be taken to the truck, emptied, and then returned to the curb.

Studies have indicated that recovery rates of recyclable material improves when bags are used in place of blue boxes and containers. From a community point of view bagged waste is tidier because it avoids having loose pages of paper and newspapers blown about the neighbourhood as often occurs when using blue boxes and containers.

Bags can be made of plastics material or paper. The recyclable materials generally consist of various metals such as aluminum and steel cans, plastic containers, and glass bottles or jar as well as fibre material such as newspapers, box board and corrugated paper. The organic waste collected typically includes kitchen organic waste and/or leaf and yard waste. Municipal solid waste includes garbage or material generally destined for landfill. The above materials and combinations thereof are referred to as refuse for the purpose of this description.

Bagged refuse is taken to a handling facility and at that facility it is necessary to have a mechanical bag opener that not only opens the bag but also empties the bag. It is desirable to have the open bag remain as a unitary piece so that it can be readily separated from the contents of the bag. This type of waste handling also has a safety feature in that the contents of the bag are displayed before being handled manually. Often there are hazardous items such as syringes and broken glass in the waste material and these are visible instead of being hidden inside the bag.

A desired characteristic of a mechanical bag opener is that it must handle a wide range of material some of which may be loose and the majority of which will be in the bags. It must handle bags that have been compacted by the packer pick-up trucks and a bag opener must also remove the contents from the bag without shredding the bag into many pieces. The bag opening machine should be able to accept common items found in the waste stream without damaging the machine some of the items for example may be lawn chairs, bicycles, frying pans, children'ss large toys, etc.

Mechanised bag openers are known and by way of example reference may be had to the following U.S. Pat. No.

: 5,639,202 issued Jun. 17, 1997 to F. Roycraft; U.S. Pat. No. 5,567,106 issued Oct. 22, 1996 to B. Gassner; U.S. Pat. No. 5,551,825 issued Sep. 3, 1996 to J. Montgomery; U.S. Pat. No. 5,484,247 issued Jan. 16, 1996 to B. Clark, et al; U.S. Pat. No. 5,484,238 issued Jan. 16, 1996 to J. Bielagus; U.S. Pat. No. 5,433,577 issued Jul. 18, 1995 to F. Roycraft; U.S. Pat. No. 5,415,515 issued May 16, 1995 to Bielagus et al; U.S. Pat. No. 5,368,431 issued Nov. 29, 1994 to E. Willey; Canadian Patent documents 2,167,997 published Aug. 3, 1996, Campbell; et al; 2,167,772 published Aug. 2, 1996, Nadarajah and Canadian Patent 2,010,489 issued Jan. 10, 1995 and issued to First Brands Industries Corporation.

Of the foregoing references U.S. Pat. Nos. 5,484,247 and 5,368,431 are considered the most closely related to applicant's apparatus. The bag breaker disclosed in the '247 patent has an in-feed hopper located directly above the bite portion of two counter rotating shafts that are of heavy construction. Because of the feed being vertically downward and directly into the bite, jamming can readily occur and/or brute force power will be required to force the bagged material between the counter rotating rollers. There is no means of controlling the rate of feed to the power driven counter rotating shafts. Also since brute force is used there can occur considerable damage and breakage making later segregating and sorting difficult particularly when glass is contained in the bagged refuse. Another disadvantage of this apparatus is that when winding occurs of the bagged contents on the shaft, as it will, the material will be difficult to remove because it will be wound upon the shafts with a very high torque. A still further disadvantage is the difficulty of accepting or passing large foreign objects between the counter rotating rolls.

The apparatus disclosed in the '431 patent includes an expensive and complicated bag opening apparatus. The bagged refuse is fed by way of a first feed conveyor onto a second input conveyor which discharges into the bite of counter rotating bag slicer and a first paddle wheel assembly. At this station the bags are sliced transverse to the direction of travel of the bagged material. From there the sliced bag and contents thereof are fed to a second pair of counter rotating rollers, the bottom one of which slices the bags longitudinally and the upper one is a second paddle which propels the contents. The transverse and longitudinal slicing obviously will cut the bag into many pieces making later sorting difficult. From the second slicing station the open bags, and contents removed therefrom, move to a further handling station by a discharge conveyor. The first and second paddle wheel assemblies are mounted on arms that pivot and use rigid paddle blades.

SUMMARY OF INVENTION

The refuse bag opener of the present invention includes controlled feeding of bagged waste to a pair of vertically spaced counter rotating cylinders. The apparatus includes a housing in which there is located first and second cylinders that are disposed horizontally in substantially parallel relation relative to one another. The cylinders are spaced from one another in vertical relation with the first cylinder having a plurality of flexible members mounted thereon and radiating outwardly therefrom. The second cylinder has a plurality of cutting knives mounted thereon and radiating outwardly therefrom and is located at a lower elevation than the first shaft. The housing has an infeed hopper with an inlet thereto located at a higher elevation than the second cylinder and offset therefrom horizontally in a direction upstream from the second cylinder. The hopper has a bottom wall inclined downwardly in a direction from said inlet towards the second cylinder for directing bagged refuse towards the lowermost one of the two cylinders. This arrangement allows gravity to assist in feeding the bagged material to counter rotating cylinders and by feeding the bagged material toward the lowermost shaft it allows the knife cylinder to slice and feed the bagged refuse to the bite of the two counter rotating cylinders.

In the preferred embodiment of the invention material flow sensor means is provided to controllably feed the bagged refuse being supplied to the counter rotating cylinders so as to allow for a continuous uniform flow of refuse through the unit and which uniform feed is important to downstream processing and efficiency. Also in the preferred embodiment the lowermost cylinder, with the knives thereon, is a relatively large diameter drum. This overcomes the problem of having the bags and other material wind around a shaft as is the case of prior art devices. In the event bags (or other material) should become wound around the drum it can readily and easily be removed because of the drum's large diameter and relatively low torque.

Power means is provided for driving the counter rotating cylinders and such power means is preferably controlled by a programmable logic controller (PLC). In a preferred embodiment of the invention an auxiliary, short-center, wide-belt feed conveyor is used to regulate the flow of material to the bite between the counter rotating cylinders. Also a material or bagged refuse flow sensing means is provided to automatically activate and deactivate a feed conveyor that feeds bagged refuse to the infeed hopper thereby ensuring an even feed of material facilitating the most efficient later downstream handling of the goods through an even feed. The auxiliary conveyor speed and/or on-off operation thereof also can be controlled by the PLC to also control the flow of material.

LIST OF DRAWINGS

The invention is illustrated by way of example in the accompanying drawings wherein.

DETAILED DESCRIPTION

Figure 1:
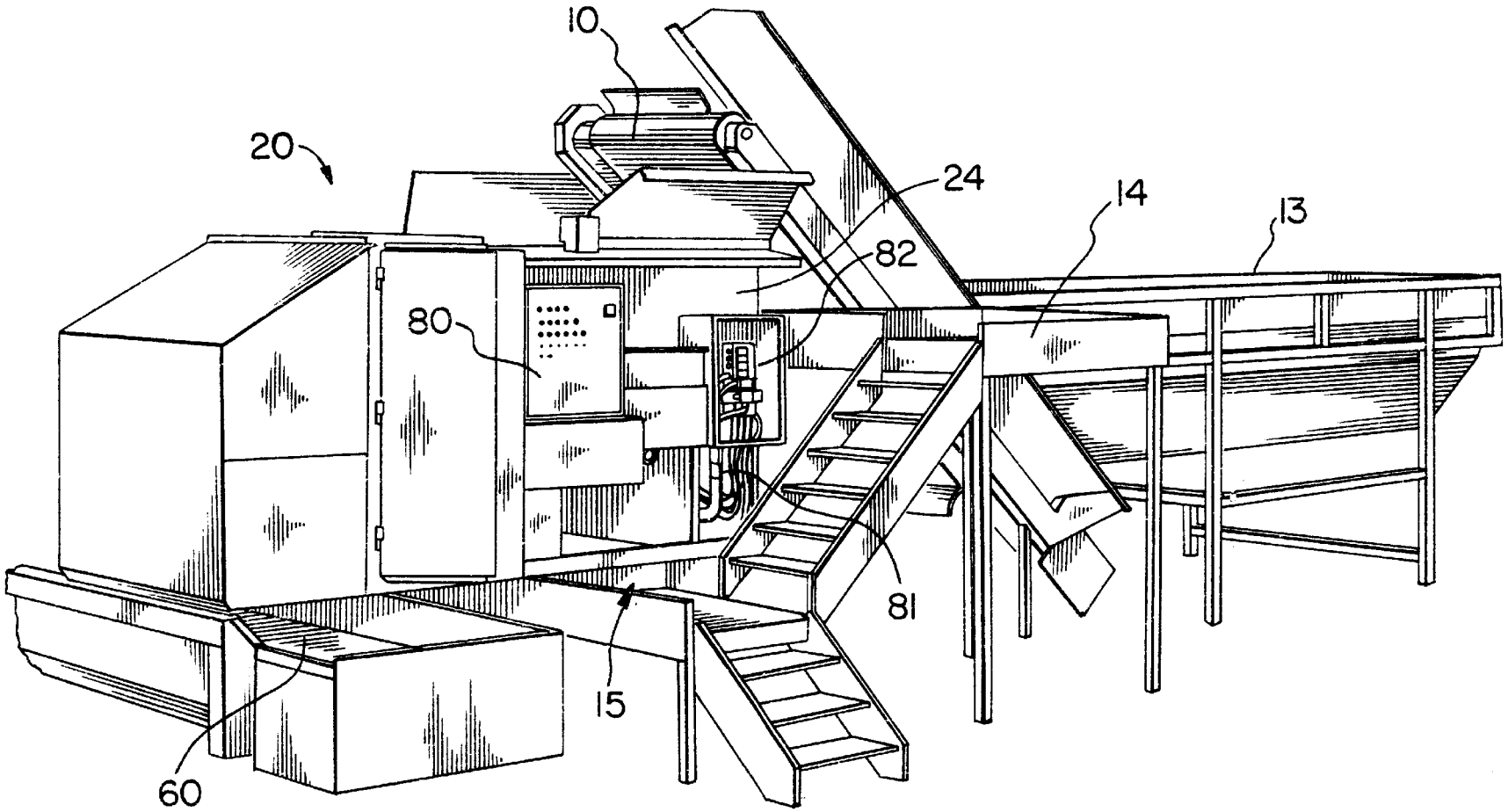
FIG. 1 is an oblique, partial schematic, of a portion of a material recovery facility incorporating a bag opening device of the present invention.

Referring to the drawings there is illustrated in FIG. 1 a portion of material recovery facility incorporating a mechanical bag opener 20. A conveyor 10 delivers bags 11 (containing refuse material and loose refuse pieces 12, see FIGS. 2 and 3) from a self-unloading hopper 13 to an inlet end of hopper 24 of the bag opener 20.

The bag opener 20 of the present invention is a compact, simple apparatus that can readily be incorporated into an existing material recovery facility with little or no modification. The bag opener 20 is a portable integrated unit that can easily be relocated to accommodate changing operations.

The infrastructure of a recovery facility may be variously designed to include unloading hoppers, sorting conveyors, transfer conveyors, platforms and sorting stations as specific applications dictate. As illustrated in FIG. 1 the infrastructure of the apparatus includes a sorting platform 14 and a control station 15. At the open output end of the bag opener 20 there is a discharge conveyor 60 that delivers the slit open bag and contents thereof to a sorting station or stations (not shown).

Platform 14 provides an area for manual presorting prior to the refuse being delivered to the inlet end of the hopper 24. This manual presorting may or may not be necessary depending upon the nature of the refuse being delivered to the recovery facility.

At the control station 15 there is a control unit 80 which includes a programmable logic controller in a housing having a control panel. The control unit and/or control panel may be located at any convenient location or mounted, as shown, on a side panel that forms part of the housing of the bag opener. The programmable logic controller controls the sequential start-up and shut down of the equipment as well as monitoring and controlling the operation to provide an even through flow of material. The PLC also provides an immediate response to an overload condition.

The control unit includes a power disconnect as well as selections of either manual or automatic operation. The control unit also provides for variable speed control. An infinitely variable speed control of motor speeds allow for changing product mix and production rate. A forward and reverse selection enables an operator to reverse direction of cylinder rotation in the event of a jam. There is also an emergency stop for immediate shut down of the entire system as well as an overload alarm to signal the operator of an overload condition.

In FIG. 1 there is illustrated a power unit 81 comprising a motor driven hydraulic pump system in which the hydraulic pump automatically adjusts pump output to match system demand.

A hydraulic manifold is provided in a casing unit 82 mounted on the housing of the apparatus and the entire operation is controlled by the programmable logic controller in the control unit 80 which has the control panel thereon.

Figure 2:
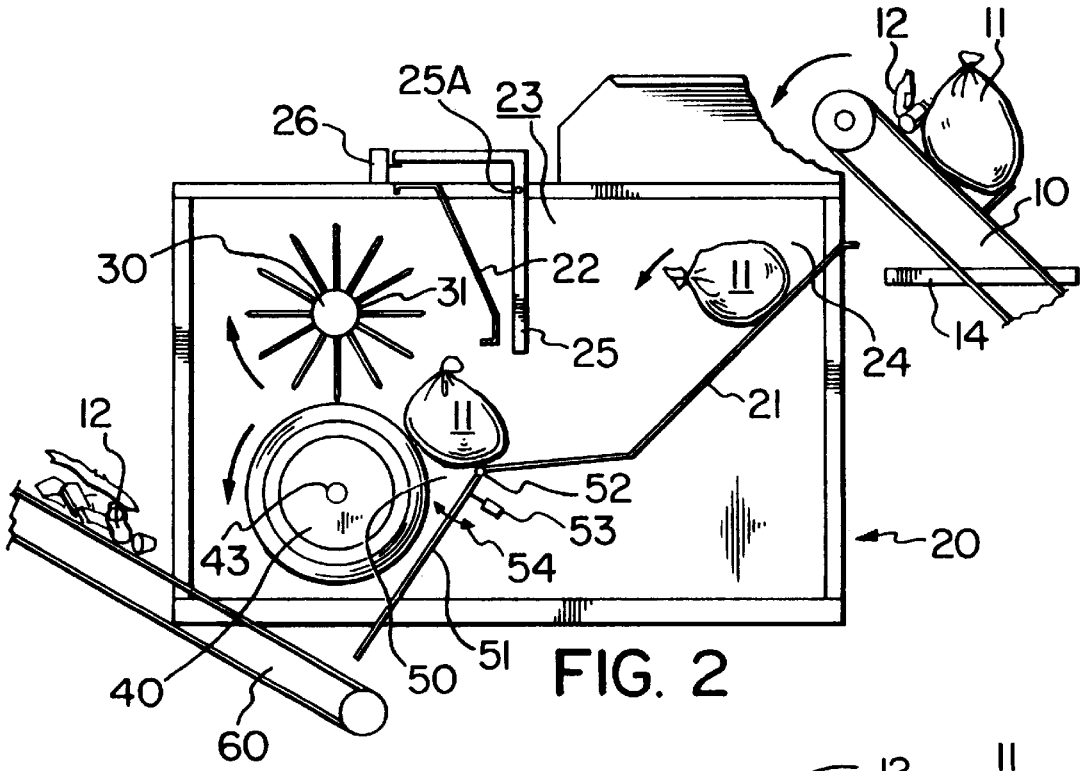
FIG. 2 is a diagrammatic, vertical sectional, view of a simplified form of applicant's bag opener.
Figure 3:
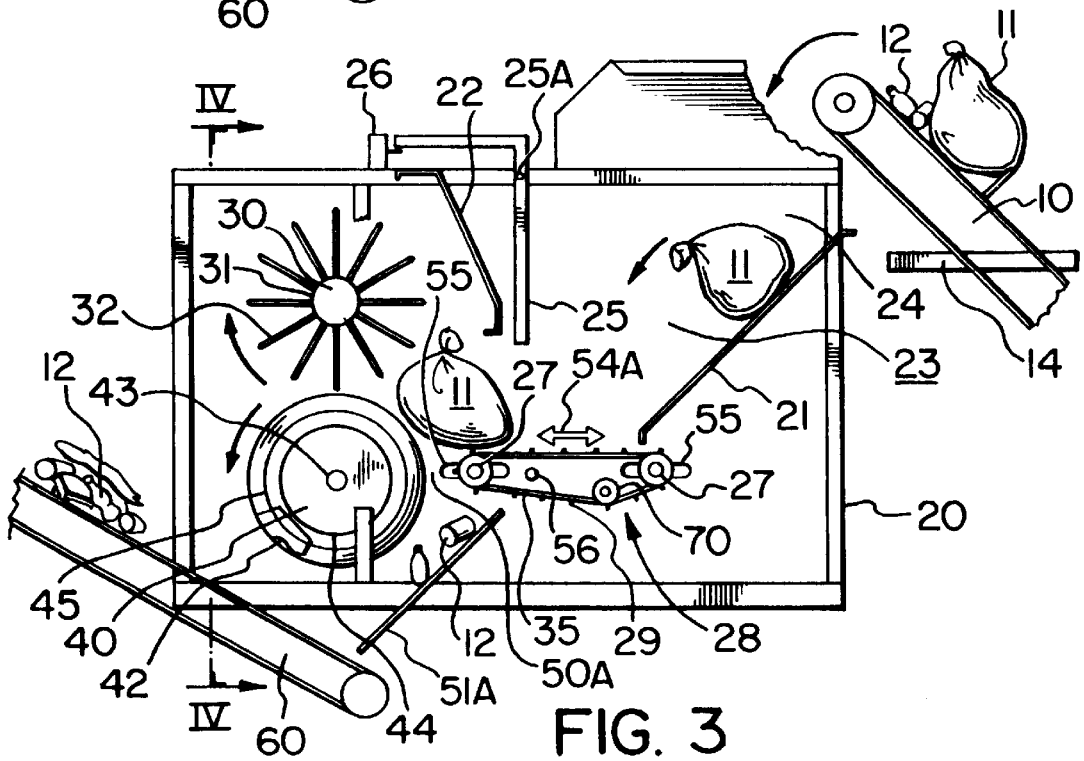
FIG. 3 is similar to FIG. 2 but in which the lower end of the infeed hopper is defined by a shortcenter, wide-belt conveyor.

The simplest form of applicant's bag opener is illustrated in FIG. 2 and the preferred more complete embodiment is illustrated in FIG. 3. Referring to these Figures the hopper 24 is defined by a downwardly sloped bottom wall 21, a front wall 22 and a pair of spaced apart opposite sidewalls 23 (only one being illustrated in FIGS. 2 and 3). The bottom wall 21 slopes downwardly in a direction from an open top inlet to the hopper towards a knife cylinder 40. Behind the hopper front wall 22, and above the knife cylinder 40, there is located a metering cylinder 30. It is preferable and intended that the amount of material fed to the knife cylinder 40 be one bag deep and this is controlled in various ways as will be discussed more fully hereinafter.

The downwardly sloped bottom wall 21 of the hopper directs the bagged material to the knife cylinder 40 and sliding or rolling of the bags downward could simply be the result of gravity assisted by vibration of the machine during operation but preferably a controlled feed means is provided. Vibration could be induced by suitable means such as a vibrator attached to for example the hopper bottom wall 21. As seen in FIG. 2, loose items may fall through gap 50 located between knife cylinder 40 and the end of hopper bottom wall 21, with the loose items dropping onto chute 51, which for example may be pivotally mounted as at 52 and controllably moved by an apparatus such as hydraulically actuated piston 53 towards and away from knife cylinder 40 in a direction as indicated by double arrow 54. As a result, gap 50 can be adjustably varied to accommodate sizes of expected loose items.

In a preferred form, however, and as illustrated in FIG. 3, there is an infeed conveyor 28 in the hopper. This conveyor is automatically controlled by suitably located sensors to automatically start, stop and/or run at a suitable speed so as to feed the desired amount of material to the bite between the knife cylinder 40 and the metering cylinder 30.

The infeed conveyor 28 having a pair of end return rollers on pulleys 27 is a short-center, wide-belt conveyor and manufacturers of such have recognized significant problems in tracking. A short-center, wide-belt conveyor refers to conveyors where the ratio of the center-to-center distance of the rollers or pulleys, over the width of the belt, is less than 5. In the present apparatus this ratio is significantly less than 1. In order to accomplish proper tracking of the belt 35, a guide and tension roller 70 is used on the inside surface of the lower return flight of the belt 35. This tension roller can be adjustably positioned by any known suitable roller mounting means.

As previously mentioned it is intended that the amount of material on the infeed conveyor 28 be only one bag deep and if the depth exceeds this the extra material trips a sensing arm 25 which in turn actuates a switch or sensor device 26. This sensor can be used to control operation and/or speed of the conveyor 10 and/or infeed conveyor 28. Control of the conveyor(s) speed and/or on/off is automatically done by the control unit 80 as required to advance the necessary material to maintain a one bag depth in a continuous feed to the knife cylinder 40.

The feed load sensing arm 25 may simply be pivotally mounted as at 25A so that movement of the lower end of the arm forwardly, caused by too much advancing bagged refuse causes actuation of the sensor or switch 26 to send a signal to the PLC for the latter to initiate proper corrective action. The feed load sensing means may be the above described mechanical arrangement of an arm (or finger) actuating a switch or it may be an electric and/or electronic sensing means or combination thereof.

The infeed conveyor 28 may have cleats 29 on the outer surface of belt 35 to assist in moving the material toward the knife cylinder.

With reference to FIG. 3, as the infeed conveyor 28 in the hopper feeds material toward the knife cylinder, loose items 12 may fall through a gap 50A located between the conveyor 28 and the knife cylinder 40 and onto a chute 51A. Gap 50A is adjusted by moving conveyor 28 towards and away from knife cylinder 40 as indicated by dual head arrow 54A. Conveyor 28 can be moved back and forth using any suitable means such as guide slots 55 for return rollers or pulleys 27 and locking bolt 56 to hold the conveyor in its selected position. Gap 50A thus can be adjustably varied to accommodate different sizes of expected loose items. The adjustment may be done manually and/or automatically.

Figure 4:
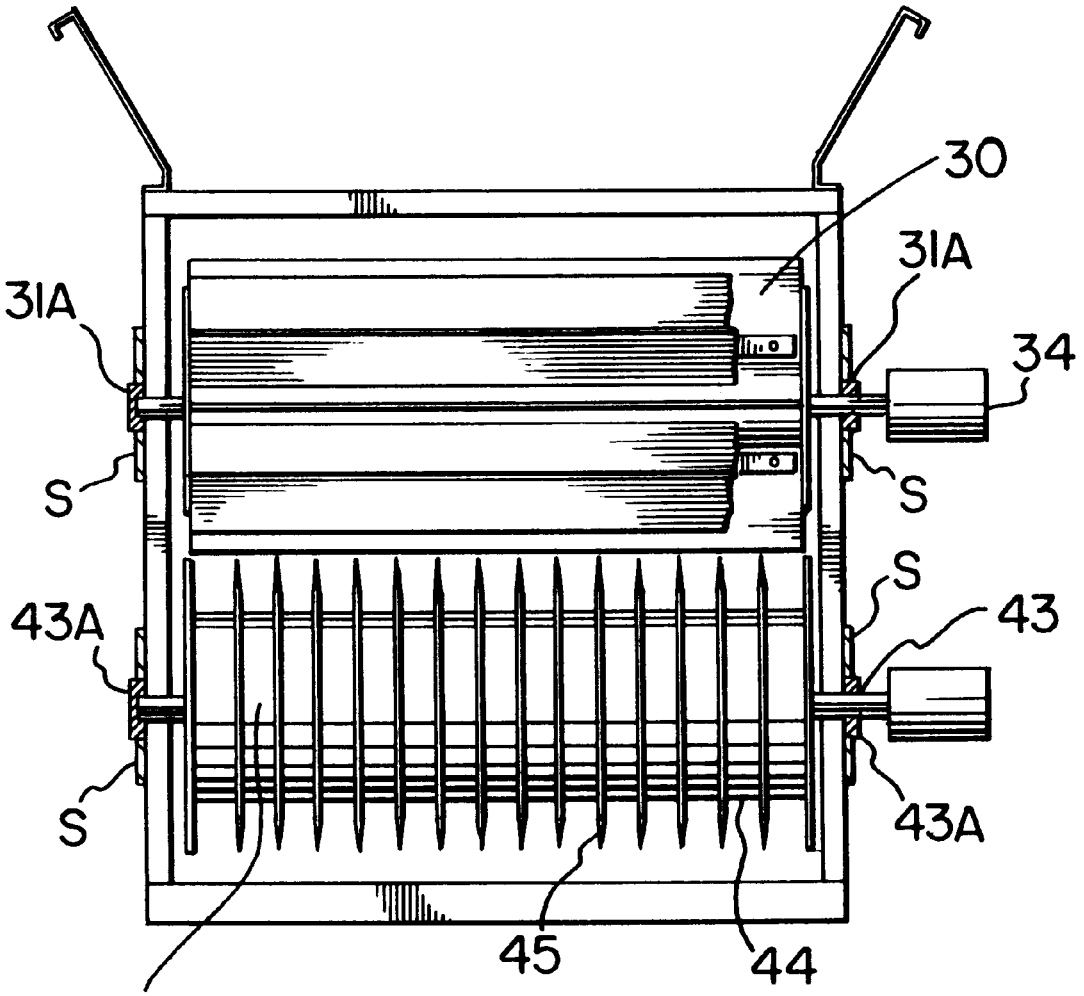
FIG. 4 is a vertical diagrammatic sectional view taken essentially along line IV—IV of FIG. 3.

The metering cylinder 30 consists of a tubular shaft 31 which is mounted parallel to the head shaft 27 of the infeed conveyor 28 at a position above the knife cylinder 40. The metering cylinder is driven by drive means 34 (FIG. 4) in a clock wise direction. This drive means may be an electric motor, or a hydraulic motor as is the case in this disclosed embodiment. Attached to the tubular shaft is a series of paddle type flexible members 32 which perform several functions.

One function is to exert force/pressure on the bags to ensure the bags contact slitting knives 42 on the knife cylinder 40.

Another function is to set the length of time a bag is in contact with the knife cylinder 40. This means the metering cylinder 30 is either holding material back until the knives have slit the bag and spilled the contents onto the discharge conveyor 60, or the metering cylinder is acting to advance the material.

Another function of the flexible members 32 is to allow foreign oversized items through the machine by flexing up to allow the object to pass.

It is also possible, in the event of an overload condition or jam, for the direction of rotation of the metering cylinder to be automatically or manually reversed. This may rearrange the orientation of the jamming item such that it may pass through on further forward rotation, otherwise the jamming item must be removed manually.

The rate of rotation of the metering cylinder 30 in conjunction with the speed of the infeed conveyor 28 acts to regulate the rate of production and, because the design arrangement allows a continuous uniform material flow through the unit, the rate of production is very uniform (even measured over short time intervals). This uniform feed to downstream processing is critical to achieve overall production efficiencies.

The rate of rotation of the metering cylinder 30, as well as that of the knife cylinder 40 and the speed of the infeed conveyor 28 can all be varied independently or proportionally by either manual means or the electronic means contained in control panel 80. This type of control is easily understood by anyone skilled in basic machine design and therefore further details of the same are not further disclosed herein.

The knife cylinder 40 is normally rotated in a counter clock wise direction at a rate which is variable and faster than the metering cylinder 30.

The knife cylinder 40 is mounted parallel to the metering cylinder 30 at a position therebelow and with its axis of rotation parallel to that of the infeed conveyor head shaft or roller 27.

The knife cylinder 40 comprises a shaft 43 (see FIGS. 3 and 4) on which a series of thin circular plates or discs 45 are attached concentric and perpendicular to the shaft 43. Spacing rings 44, concentric with the shaft 43, are fitted between each circular plate. The spacing rings determine the distance between each circular plate and also stop material from winding onto the shaft 43. The spacing rings are of large diameter, relative to that of shaft 43, and thus act to prevent material from winding on the cylinder.

The width of the spacing rings 44 may be designed to meet requirements depending on the expected size of bags to be opened.

The circular plates or discs 45 can act themselves as a rotary slitting knife or replaceable knife sections 42 can be mounted on the periphery of the circular plate 45. The circular plate 45, or the replaceable knife sections 42, as the case may be, can utilize various knife profile designs, depending on the expected contents of the bags. The individual knives 42 would be suitably spaced circumferentially around and longitudinally along the cylinder 40.

As previously described, the knife cylinder rate of rotation can be varied independently or proportionately with the rate of rotation of the metering cylinder or the speed of the hopper feed conveyor.

The knife cylinder 40 can also be operated in a reverse or clockwise direction, the direction of rotation can be set by manual control or by automatic operation.

Reversing the direction of rotation of the knife cylinder may rearrange material which has caused a jam or overload. When the knife cylinder is reset in the forward (counter clockwise) direction, the jamming item may pass through. This forward, reverse, forward operation may be controlled manually or automatically.

If this does not clear a jamming condition, then the jamming item must be removed manually.

The relative spacing between the knife cylinder 40 and metering cylinder 30 can be designed to meet conditions depending on the expected bag size and contents. One or the other or both of bearing supports 31A and 43A (FIG. 4) of respective shafts 31 and 43 may be mounted on track style sliders so that the mentioned relative spacing may be adjusted manually and/or automatically.

By raising the metering drum significantly away from the knife drum, foreign jamming objects can be passed through the Bag Opener and again such raising may be manual but preferably it is automatic.

Once a bag has passed between the metering cylinder 30 and the knife cylinder 40, the bag will have been slit sufficiently to allow the contents to spill out onto the discharge conveyor 60 on which there may be loose material deposited from the chute 51 or 51A.

The bag is typically left in one piece for removal. Removing the bag from amongst the contents is typically done manually by sorting personnel.

The foregoing described feed and control of feed to the bite between the knife cylinder 40 and the metering cylinder 30 provides a relatively even through flow of material. This is despite the fact that the material arrives having been compacted and in various states. The bagged refuse is generally collected in a compactor style truck where the bags are packed into a closed container. This packing along with the nature of the bagged material causes the bags to nest together. The feed conveyor 10 is controlled by the level of material in the hopper 24 by way of the feed speed sensor 25. On/off operation of the conveyor 10 and/or control of the speed thereof through actuation of sensor or switch 26 and/or control of the infeed conveyor 28 allows the clumps of bags to be separated apart. The infeed conveyor 28 then presents to the bag opener counter rotating drums separated bags which are significantly easier for the metering cylinder 30 and knife cylinder 40 to get hold of and perform the slicing and emptying function.

The present equipment through extensive development and testing has proven effective. The hydraulic drive system provides for a wide range of speed control and is easy to match input horsepower to required horsepower. There is economical overload protection and it is easy to add peripheral equipment drives. Electric motor drives in some instances, however, may be preferred as it simplifies design and reduces cost.

The equipment has been found suited to handling foreign and oversized objects. Shaft winding of bags and/or material that has been an issue with prior equipment has been minimized. Glass breakage, considered a significant issue in waste handling, is minimized by the use of flexible members 32 on the metering cylinder 30. While a paddle arrangement is preferred with flexible web like members extending parallel to the rotating shaft and radiating outwardly therefrom it would be possible to use separate and individual flexible members spaced circumferentially and longitudinally along the shaft.

We claim:

1. A refuse bag opener comprising a housing, a first cylinder located in said housing and mounted thereon for rotation about a horizontal axis, said first cylinder having flexible members mounted thereon and radiating outwardly therefrom, a second cylinder in said housing and mounted thereon for rotation about a horizontal axis substantially parallel to that of said first cylinder, said first and second cylinders being disposed in vertical spaced relation relative to one another with said second cylinder being at a lower elevation than said first cylinder, said second cylinder having cutting members on the outer surface thereof for slitting open bagged refuse, said housing having an infeed hopper with an inlet thereto at an elevation higher than that of said second cylinder and horizontally offset from such cylinder in a direction upstream of said first and second cylinders, said hopper having a bottom wall inclined downwardly in a direction towards said second cylinder, an infeed conveyor at a lower end portion of said hopper bottom wall for feeding bagged refuse horizontally directly towards said second cylinder having the cutting members thereon, material flow sensor means located within said infeed hopper for monitoring the height of bagged refuse in said infeed hopper being fed to said second cylinder and for disrupting any additional supply of bagged refuse to said inlet of said infeed hopper when said height of bagged refuse is above a predetermined height, and drive means for driving said cylinders to rotate the same in opposite directions to propel the bagged refuse therebetween.

2. A refuse bag opener as defined in claim 1 wherein a gap between said second cylinder and said infeed conveyor is adjustable by moving said infeed conveyor relative to said second cylinder.

3. A refuse bag opener as defined in claim 2 wherein said infeed conveyor is a short-center, wide-belt conveyor.

4. A refuse bag opener as defined in claim 3 wherein said infeed conveyor comprises a belt looped around a pair of spaced apart rollers and including means for adjusting the tracking of said belt on said rollers, said tracking means comprising an auxiliary roller rolling on an inside surface of said belt at a location on the return lower flight portion of the belt.

5. A refuse bag opener as defined in claim 1 wherein said second cylinder includes a relatively large diameter drum mounted on shaft means and wherein said cutting members comprise cutting knives which are located on the outer surface of said drum.

6. The apparatus as defined in claim 5 wherein said cutting knives extend continuously circumferentially around said drum.

7. The apparatus as defined in claim 5 wherein said cutting knives are spaced from one another circumferentially around and longitudinally along said second cylinder.

8. The refuse bag opener as defined in claim 1 wherein the spaced relationship between said first cylinder and said second cylinder is adjustable.

9. A refuse bag opener comprising:

(a) a housing having a hopper defined by a pair of spaced apart sidewalls, a front wall and a bottom wall, said hopper having an inlet for receiving a supply of bagged refuse, said bottom wall sloping downwardly in a direction away from said inlet toward an open discharge, said open discharge being horizontally offset from said inlet, (b) a pair of cylinders located in said hopper and mounted for rotation about respective ones of a pair of horizontal axes that are disposed in vertical spaced relation, said pair of cylinders being offset horizontally from said hopper inlet in a direction toward said hopper open discharge and upstream of the latter, (c) knife means on an outer surface of the lowermost one of said pair of cylinders for cutting open bags of bagged refuse, (d) flexible means on and projecting outwardly from the outer surface of the uppermost one of said pair of cylinders, (e) an infeed conveyor being disposed at a lower end portion of said hopper bottom wall for feeding bagged refuse towards said lowermost one of said cylinders, (f) material flow sensor means positioned above said infeed conveyor for monitoring the height of bagged refuse on said conveyor and for disrupting the supply of bagged refuse to said inlet of said hopper when the height of said bagged refuse is above a preselected height and, (g) means to drive said pair of cylinders to rotate them in opposite directions and to propel bagged refuse therebetween in a direction from said hopper inlet toward said open discharge.

10. A refuse bag opener as defined in claim 9 wherein a gap between said lowermost one of said cylinders and said infeed conveyor is adjustable by moving said infeed conveyor relative to said lowermost one of said cylinders.

11. A refuse bag opener as defined in claim 10 wherein said cylinders each extend from one to the other of said pair of sidewalls.

* * * * *